US006774855B2

(12) United States Patent
Bateman et al.

(10) Patent No.: US 6,774,855 B2
(45) Date of Patent: Aug. 10, 2004

(54) OMNI-DIRECTIONAL ANTENNA ARRAYS AND METHODS OF MAKING THE SAME

(75) Inventors: Blaine R. Bateman, Louisville, CO (US); Randy Bancroft, Denver, CO (US); Gary Cumro, Alvo, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 29 days.

(21) Appl. No.: 10/342,621

(22) Filed: Jan. 15, 2003

(65) Prior Publication Data

US 2003/0234748 A1 Dec. 25, 2003

Related U.S. Application Data

(60) Provisional application No. 60/390,947, filed on Jun. 24, 2002.

(51) Int. Cl.[7] ..... H01Q 1/38

(52) U.S. Cl. ..... 343/700 MS; 343/790

(58) Field of Search ..... 343/700 MS, 790, 343/791, 792, 795, 852, 864

(56) References Cited

U.S. PATENT DOCUMENTS 3,031,668 A * 4/1962 Bryson ..... 343/790
5,285,211 A * 2/1994 Herper et al. ..... 343/791
5,926,149 A * 7/1999 Rummeli et al. ..... 343/791
5,963,168 A * 10/1999 Brennan ..... 343/700 MS

* cited by examiner

*Primary Examiner*—Hoang V. Nguyen
(74) *Attorney, Agent, or Firm*—Holland & Hart LLP

(57) ABSTRACT

The present invention provides a support for an antenna. In particular, the present invention provides a substrate with conductive transition pads for a co-linear coaxial antenna array. The transition pads are constructed and arranged to properly provide power and phase shifting to the antenna array.

40 Claims, 7 Drawing Sheets

OMNI-DIRECTIONAL ANTENNA ARRAYS AND METHODS OF MAKING THE SAME

This application claims the benefit of U.S. Provisional Application No. 60/390,947, filed Jun. 24, 2002, titled OMNI-DIRECTIONAL ANTENNA ARRAYS AND METHODS OF MAKING THE SAME.

FIELD OF THE INVENTION

The present invention relates to antenna arrays and, more particularly, to omni-directional antenna arrays.

BACKGROUND OF THE INVENTION

Radio frequency antennas are often designed as arrays to provide sufficient gain. The power feed network associated with antenna arrays, however, is often complex. The power feed network is complex because antenna pattern and gain depend on physical and network parameters. Some physical parameters include the number of elements and their spacing. Some feed network parameters include the phase and amplitude of the power signal at each of the antenna feeds as well as the impedance of the feed network delivering the power.

One omni-directional antenna array that has a relatively non-complex feed network is a co-linear coaxial antenna array. FIG. 1 shows a conventional co-linear coaxial (COCO) antenna array 100. COCO antenna 100 comprises a feed coax cable section 102, a plurality of coax cable sections 104, and a termination coax cable section 106. Connecting each section of coax 102, 104, and 106 is a wire pair 108. Wire pair 108 includes a center wire to shield wire 108*a* and a shield wire to center wire 108*b*. A power feed 110 is connected between feed coax cable section 102 and the first of the plurality of coax cable sections 104. Power feed 110 has a connection 110*a* to the shield of feed coax cable section 102 and a connection 110*b* to the shield of the first of the plurality of coax cable sections 104. Connection 110*a* runs to a short connection 112 internal to feed coax cable section 102, which also connects power to the center wire 114 of feed coax cable section 102. Termination coax cable section 106 similarly has a center wire 116 connected to a short 118. Other than the power feed 110 connection, feed coax cable section 102 and termination coax cable section 106 are images of each other. (Notice, determining lengths of the coaxial cable and other dimensions of the COCO antenna 100 are well known in the art and will not be explained further herein.)

The coax cable can be any conventional coax cable such as 50 ohm or 75 ohm coax cable. The coax cable can be flexible or in a semi-rigid sheath. Using 50 ohm cable, a ¼ wave transformer may be needed in the power feed coax cable section 110. The cable sections 102, 104, and 106 are stripped and soldered to wire pairs 108 to make the connections. Moreover, the shorts 112 and 118 are located and soldered. The above example, and the description of the present invention, below, relate to conventional 50 ohm coax cable, but one of skill in the art would recognize other cable or radiating elements are possible.

The COCO antenna 100 provides an omni-directional RF antenna with a good power gain for lower frequency operation. However, the conventional COCO antenna 100, explained above, has several problems. The problems include: the construct is fragile, the electrical connections have defects, the solder placement lacks consistency, and the coax stripping is inconsistent. In general, the conventional COCO antenna 100 has a minimum error associated with its construction and handling the assembly is difficult. While these manufacturing and assembly errors can be tolerated at lower operating frequencies, at higher frequencies, such as the 5 GHz range, the errors become prohibitive. The prohibitive nature of the errors is due, in part, to the smaller lengths of coax and wires used. As the frequency increases, the wavelength, and the lengths of each section decrease. The smaller lengths of wire make the errors relatively higher, causing unacceptable degradation of the antenna pattern and gain. Also, the fragile nature of the conventional COCO antenna (coax cable sections soldered together) makes handling and assembly of the construct difficult if not prohibitive.

Thus, it would be desirous to provide a COCO antenna that had lower errors and was less fragile.

SUMMARY OF THE INVENTION

To attain the advantages of and in accordance with the purpose of the present invention, a support for an omni-directional antenna is provided. The support comprises a substrate with pre-placed transition pads and a feed pad. Coaxial cable could be soldered to the transition pads to form a co-linear coaxial antenna array.

The present invention further provides methods for designing the support including arrangement of transition pads on a substrate. A feed transition pad is also arranged on the substrate. Coaxial cable attached to the substrate at the transition pads would form a co-linear coaxial antenna array.

The foregoing and other features, utilities and advantages of the invention will be apparent from the following more particular description of a preferred embodiment of the invention as illustrated in the accompanying drawings.

BRIEF DESCRIPTION OF THE DRAWING

The above and other objects and advantages of the present invention will be apparent upon consideration of the following detailed description, taken in conjunction with the accompanying drawings, in which like reference characters refer to like parts throughout, and in which.

DETAILED DESCRIPTION

Figure 1:
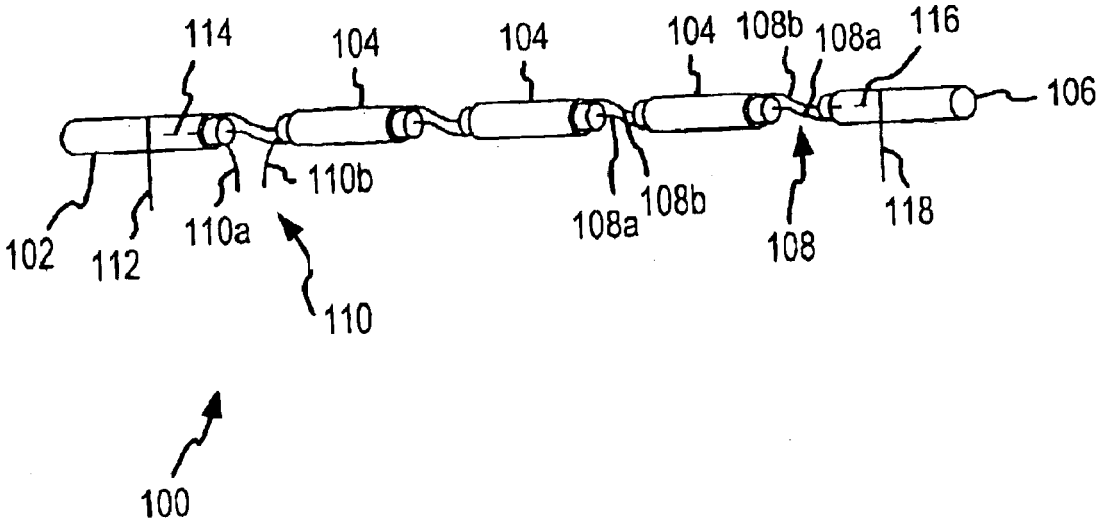
(PRIOR ART) FIG.1
FIG. 1 is a conventional co-linear coaxial antenna construct.

FIGS. 2–8 and the following paragraphs describe some embodiments of the present invention. Like reference characters are used wherever possible to identify like components or blocks to simplify the description of the various subcomponents described herein. More particularly, the present invention is described in relation to a co-linear coaxial antenna, however, one of ordinary skill in the art will understand other antenna arrays are possible without departing from the spirit and scope of the present invention.

Figure 2A:
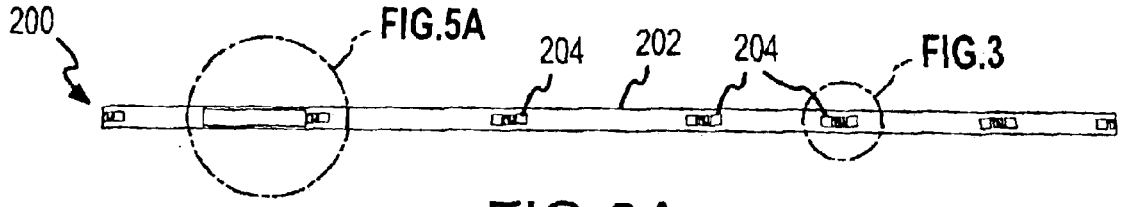
FIG. 2A is a top side plan view of a baseboard in accordance with the present invention.
Figure 2B:
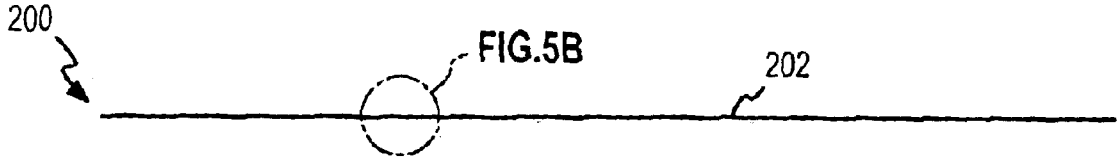
FIG. 2B is a side elevation view of the baseboard of FIG. 2A.
Figure 2C:
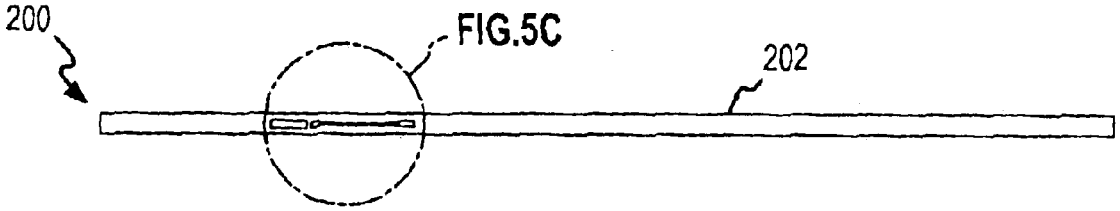
FIG. 2C is a bottom side plan view of the baseboard of FIG. 2A.

Referring to FIGS. 2A, 2B, and 2C, a co-linear coaxial antenna baseboard 200 exemplary of the present invention is shown. FIG. 2A shows a top side plan view of baseboard 200. FIG. 2B shows a side elevation view of baseboard 200. FIG. 2C shows a bottom side plan view of baseboard 200. Baseboard 200 includes a substrate 202 having a plurality of transition pads 204. Substrate 202 can be any non-conductive substrate, but it has been found conventional printed circuit board substrates work well. Transition pads 204 are generally a conductive material, such as copper. Transition pads 204 will be explained further below with reference to FIG. 3. Baseboard 200 also includes a feed pad 524, a feed cable connector 522, and a ground plane 504. Feed pad 524, connector 522, and ground plane 504 will be explained further below with reference to FIGS. 5A, 5B, and 5C.

Figure 3:
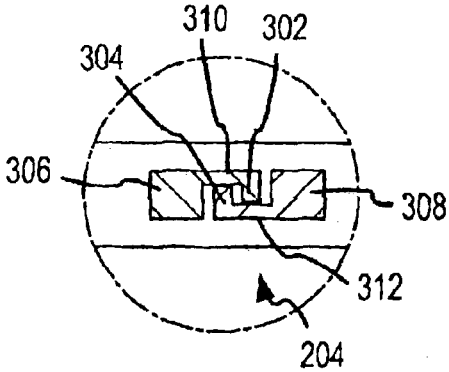
FIG. 3 is shows a transition pad of FIG. 2A in more detail.

Connecting coaxial cable to the transition pads 204 will be explained with reference to FIGS. 3 and 4. FIG. 3 shows one transition pad 204 in more detail. Transition pad 204 includes two center wire connections 302 and 304 and two shield connections 306 and 308. A Transition connection 310 connects center wire connection 302 and shield connection 306 and a transition connection 312 connects center wire connection 304 and shield connection 308.

Figure 4:
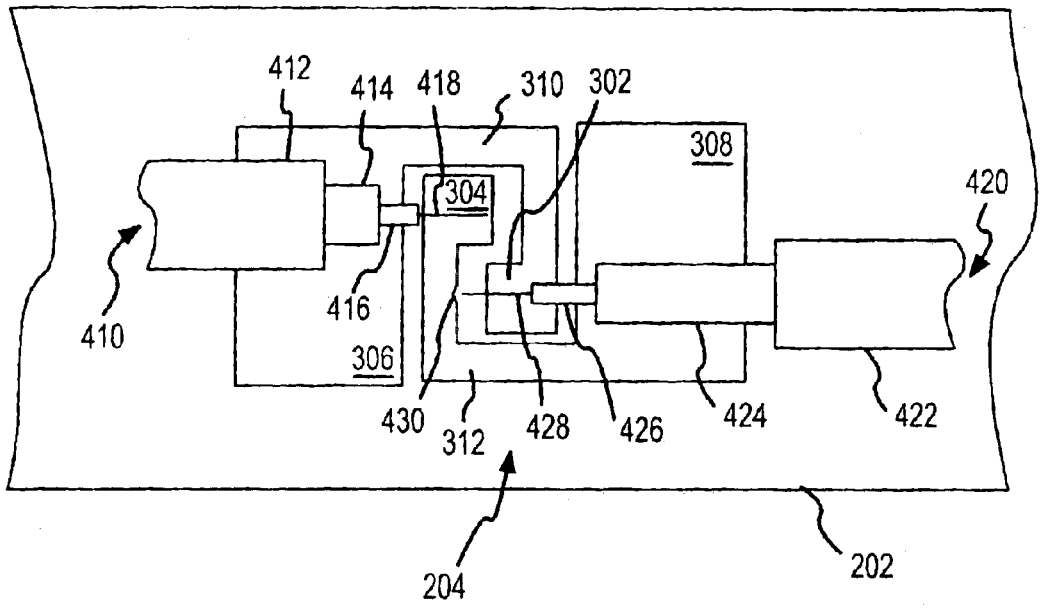
FIG. 4 is illustrative of connecting downstream coaxial cable and upstream coaxial cable using the transition pad of FIG. 3.

Referring now to FIG. 4, transition pad 204 is connected to downstream coaxial cable 410 and upstream coaxial cable 420. Downstream coaxial cable 410 has a jacket 412, a shield (or braid) 414, an insulator 416, and a center wire 418. Similarly, upstream coaxial cable 420 has a jacket 422, a shield 424, an insulator 426, and a center wire 428. Center wire 418 is soldered (or otherwise electrically coupled) to center wire connection 304 and shield 414 is soldered to shield connection 306. Center wire 428 is connected to center wire connection 302 and shield 424 is connected to shield connection 308. In this configuration, downstream coaxial cable 410 has its center wire 418 electrically coupled to shield 424 of upstream coaxial cable 420. Similarly, downstream coaxial cable 410 has its shield 414 electrically coupled to center wire 428 of upstream coaxial cable 420.

As shown in FIG. 4, the placement of center wires 418 and 428 do not need to be perfectly placed prior to soldering the wires to center wire connections 304 and 302. Also, shields 414 and 424 do not need to be perfectly placed prior to soldering the shields to shield connections 306 and 308. Moreover, because the transition pads 204 can be placed with a degree of accuracy, because some of the human factors errors associated with soldering the downstream cable to the upstream cable are removed, and because some of the error associated with stripping the coaxial cable is removed, using the baseboard 200 allows manufacturing co-linear coaxial antenna arrays that can be used at higher frequencies, such as the 5 GHz range.

While transition pad 204 is shown using generally rectangular portions, the geometric configuration of the transition pad is largely a matter of design choice. In other words, the connections could be round, elliptical, square, triangular, or a combination of multiple or random shapes. For example, connection 304 is shown having a dimple 430 (which could also be a slot, a groove, a semi-circle, or the like) located substantially adjacent where center wire 428 connects to center wire connection 302 to allow for more or less overhang to accommodate for machine stripping tolerances, human error relating to center wire 428 placement, or the like. Further, the gaps between the conductive pads can be widened or narrowed to accommodate errors in placement, stripping or the like.

Although transition pads 204 have been described as being used to solder coaxial cables 410 and 420 and the like, it is possible to connect the coaxial cables at transitions 204 using other means, such as coaxial connectors, press-in connections, adhesives, or other means, while still maintaining the intent of the present invention.

Figure 5A:
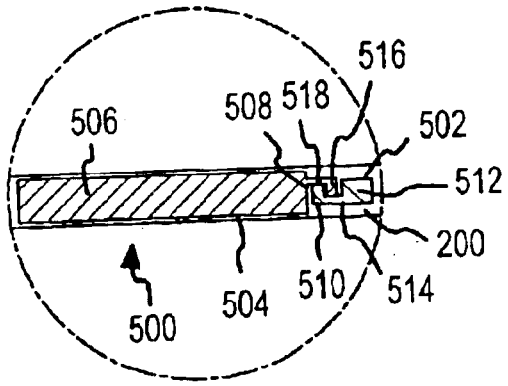
FIG. 5A is a top side plan view of a power feed in accordance with the present invention.
Figure 5B:
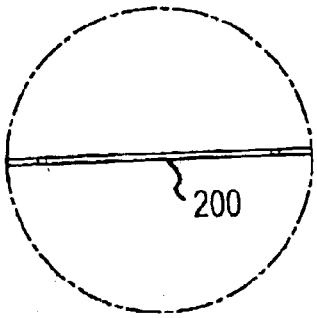
FIG. 5B is a side elevation view of the power feed of FIG. 5A.
Figure 5C:
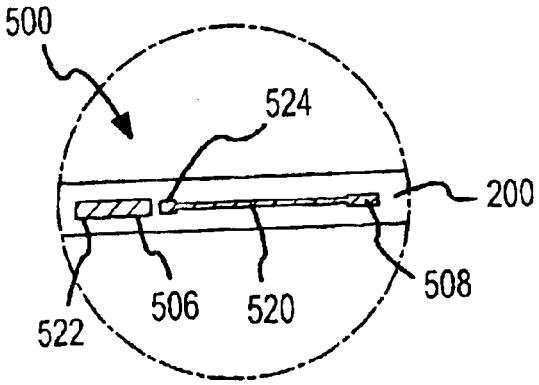
FIG. 5C is a bottom side plan view of the power feed of FIG. 5A.

FIGS. 5A, 5B, and 5C illustrate a power feed 500 for the omni-directional antenna array described above. FIG. 5A shows a top side plan view of power feed 500 on baseboard 200. FIG. 5B shows a side elevation view of the power feed 500 on baseboard 200. FIG. 5C shows a bottom side plan view of power feed 500 on baseboard 200. FIG. 5A further shows power feed 500 comprises a feed transition pad 502, a ground plane 504, and two vias 506 and 508. Feed transition pad 502 has ¼ wave transformer connection 510 and shield connection 512 connected by feed connection 514. ¼ wave transformer connection 510 includes via 508. Power feed 500 further comprises a ground 516 connected to ground plane 504 by ground connection 518.

FIG. 5C shows the bottom side plan view of power feed 500. The bottom side of power feed 500 includes the vias 506 and 508. Via 508 is connected to a ¼ wave transformer 520 to match the 50 ohm coaxial cable used in the omni-directional antenna array, although one of skill in the art would recognize on reading the disclosure other coaxial cable, the most common of which are 50 ohm and 75 ohm coaxial cable, could be used. ¼ wave transformer 520 is any conductive material, but generally is constructed of the same material as the transition pads 204. Via 506 is connected to connector 522. Connector 522 provides a mechanism to attach a power feed (not specifically shown in FIG. 5C, but shown in FIG. 7) to the omni-direction antenna array.

Figure 6:
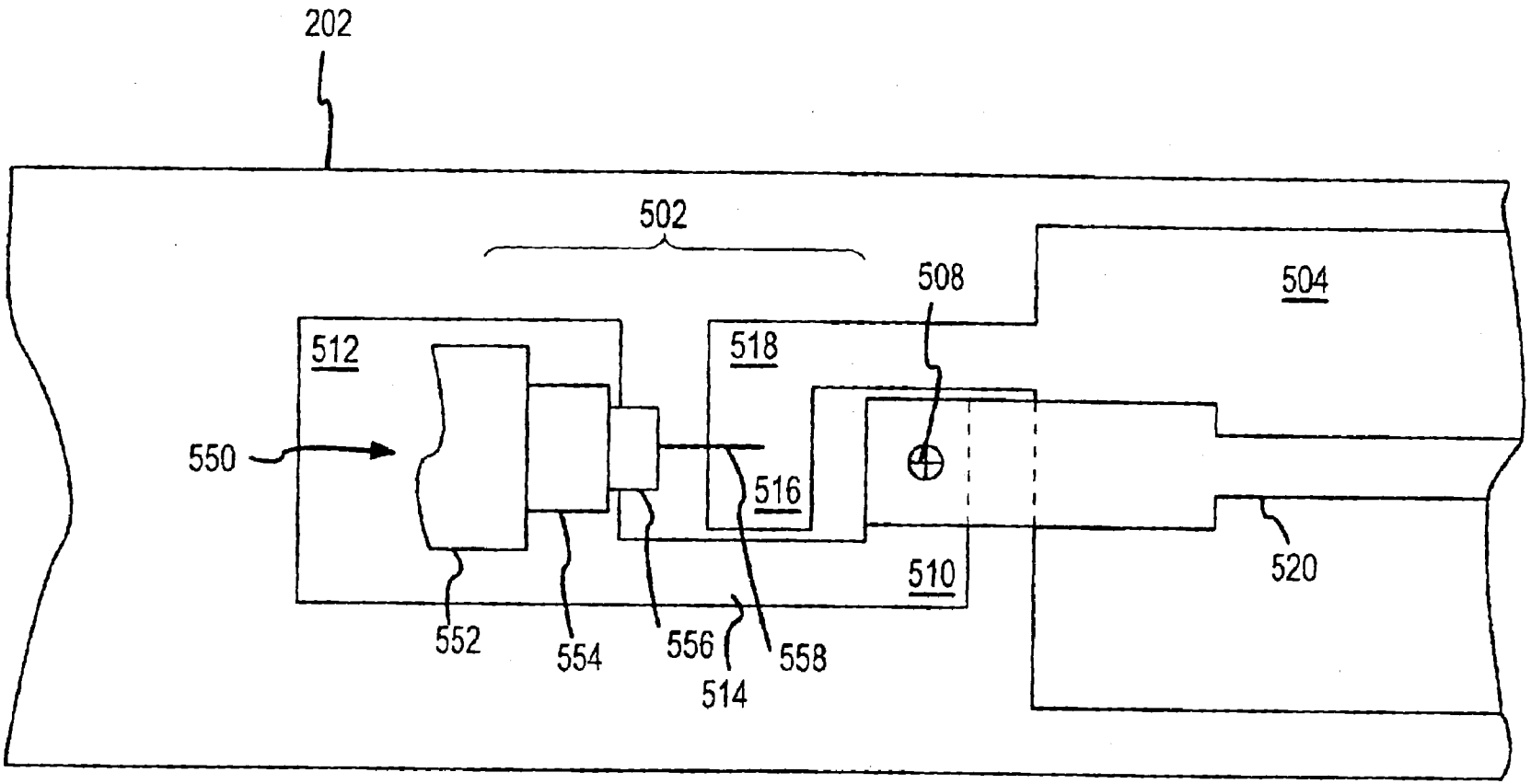
FIG. 6 is illustrative of connecting a downstream coaxial cable to a power feed shown in FIG. 5A.

FIG. 6 shows connecting the omni-directional antenna array to feed transition pad 502. FIG. 6 shows coaxial cable 550 having a jacket 552, a shield 554, an insulator 556, and a center wire 558. The center wire 558 is connected to ground 516, which in turn is connected to the ground plane 504 by ground connection 518. Shield 554 is connected to shield connection 512, which in turn is connected to ¼ wavelength transformer 520 through feed connection 514 and ¼ wave transformer connection 510. The same comments given above regarding transition pad 204 about the geometry, shape, and benefits of the present invention at the point the coaxial cable is attached, apply equally to feed transition pad 502.

Figure 7:
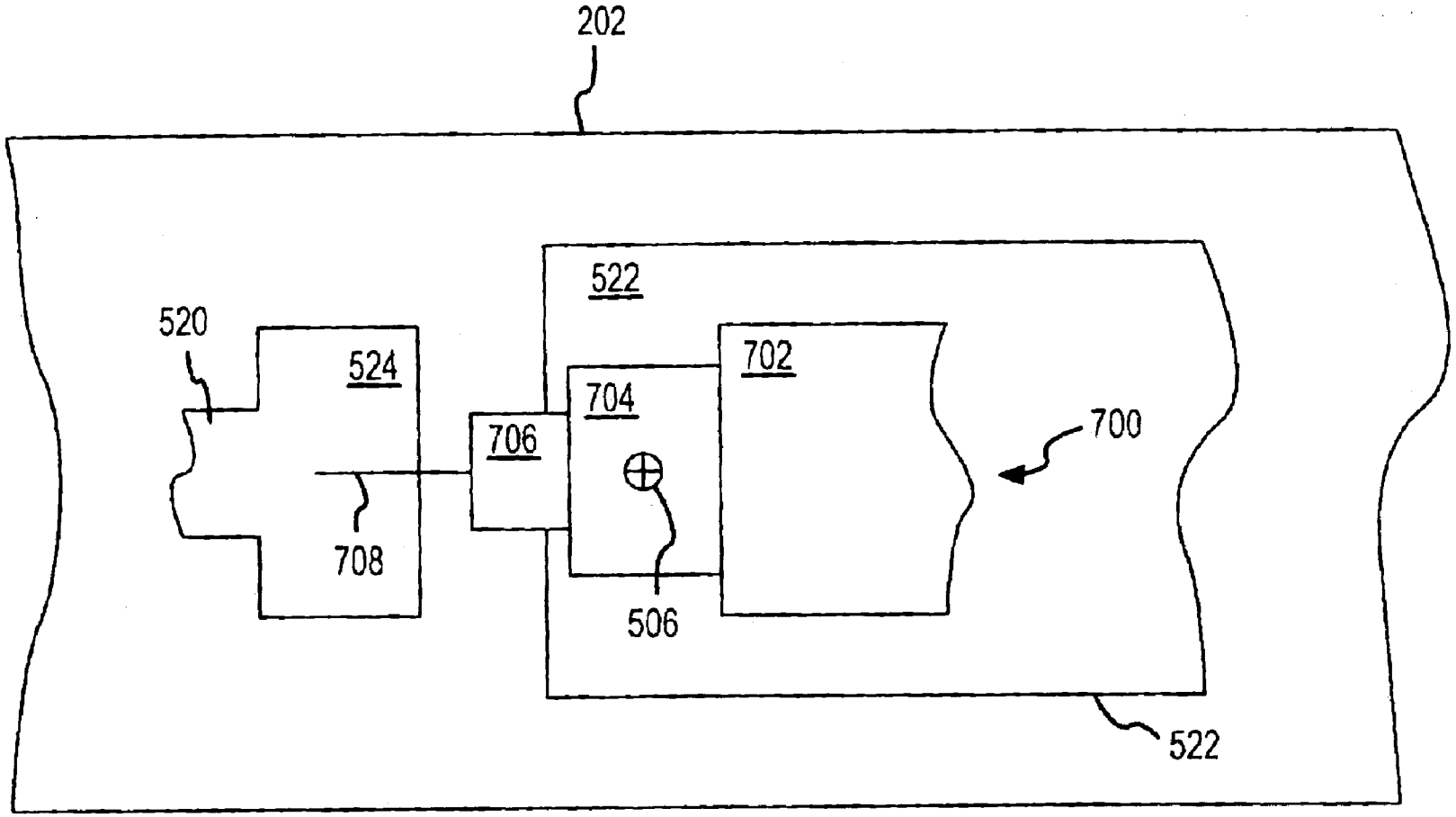
FIG. 7 is illustrative of connecting a power feed cable in accordance with the present invention.

FIG. 7 illustrates connecting a power feed cable 700 to the omni-directional antenna array. Power feed cable 700 includes a jacket 702, a shield 704, an insulator 706 and a feed center wire 708. Feed center wire 708 is attached to ¼ wave transformer connection 524, which connects to ¼ wave transformer 520, which connects to ¼ wavelength transformer connection 510 and shield 554 through via 508. Feed shield 704 connects to ground plane 504 through via 506, which connects to center wire 558 through ground 516.

Notice that while FIG. 7 shows providing the power feed using a feed cable 700, other means of feeding the array are possible as would be evident to one skilled in the art. For example, a coaxial connector could be attached to ¼ wavelength transformer 520 and ground plane 522, using suitable geometry. Other means, including capacitively coupled feeds are possible and may be envisioned by one skilled in the art.

Figure 8:
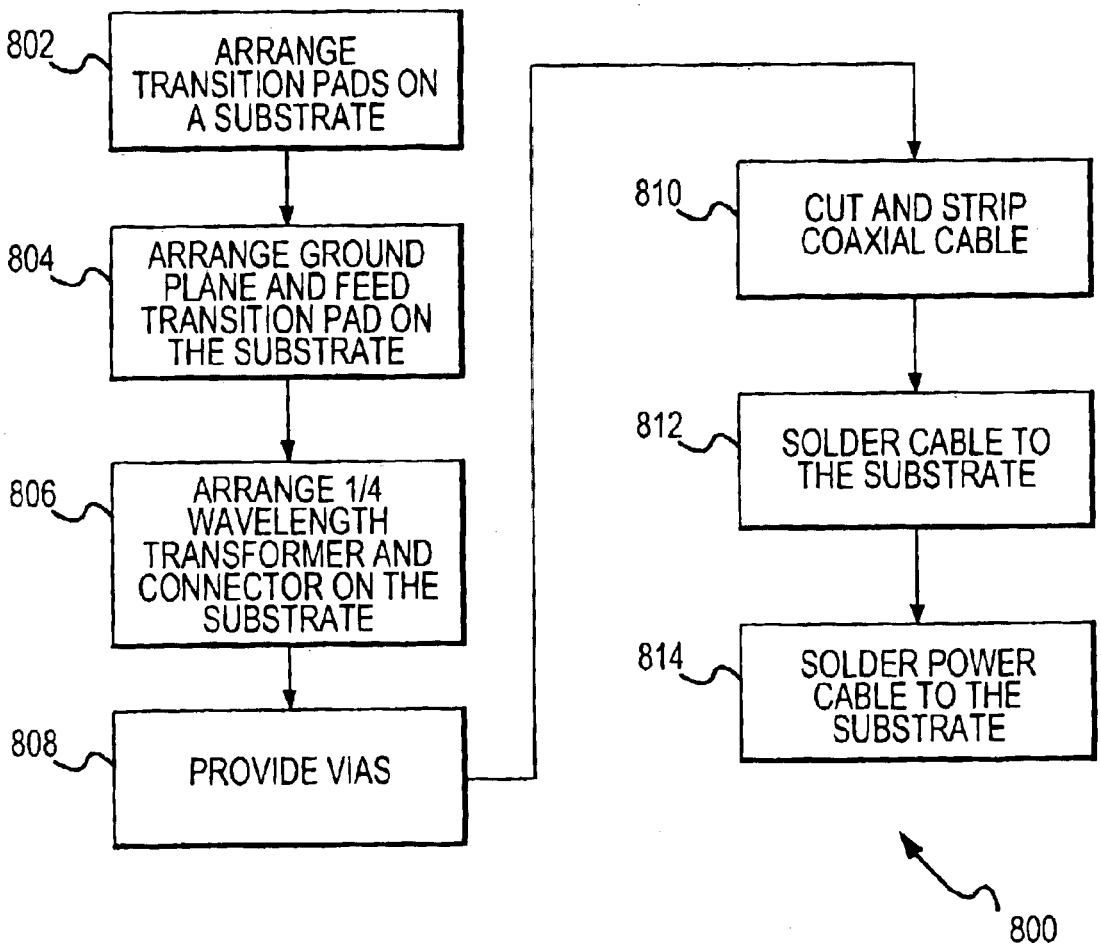
FIG. 8 is a flowchart illustrative of a method of making omni-directional antenna arrays in accordance with the present invention.

FIG. 8 is a flowchart 800 illustrative of a method of making an omni-directional antenna array in accordance with the present invention. While other transmission line elements are possible, the flowchart assumes the use of coaxial cable. First, at least one transition pad is arranged on a top side of a substrate, step 802. The ground plane and feed transition pad are arranged on the top side of the substrate, step 804. The ¼ wavelength transformers and connector are arranged on the bottom side of the substrate, step 806. Vias are provided from the ground plane to the connector and the ¼ wavelength transformer to the feed transition pad, step 808. Notice, steps 802, 804, 806, and 808 could be performed in numerous orders or performed substantially simultaneously. In other words, the order of steps 802, 804, 806, and 808 should be considered exemplary and not limiting.

Once the baseboard is prepared, steps 802 through 808, the omni-directional antenna array is built by, for example, cutting and stripping coaxial cable to the appropriate lengths, step 810. Notice the coax could be cut and stripped before the baseboard is prepared. Next the stripped coaxial cable is placed on the baseboard and soldered (or otherwise electrically connected), as explained with reference to FIGS. 4 and 6, step 812. Finally, the power cable is electrically connected, as explained with reference to FIG. 7, step 814.

The conductive portions, such as transition pads 302, can be placed on substrate 202 using any conventional attaching means. For example, the conductive portions can be built up on substrate 202 or etched away on substrate 202.

While the invention has been particularly shown and described with reference to a preferred embodiment thereof, it will be understood by those skilled in the art that various other changes in the form and details may be made without departing from the spirit and scope of the invention.

We claim:

1. A support for an omni-directional antenna array, comprising:

a substrate;

at least one transition pad placed on the substrate; and at least one feed transition pad placed on the substrate, wherein the at least one transition pad and the at least one feed transition pad are placed such that attaching coaxial cable will form a co-linear coaxial antenna.

2. The support according to claim 1, further comprising:

at least one ground plane connected to the at least one feed transition pad.

3. The support according to claim 2, further comprising:

at least one impedance matching section connected to the at least one feed transition pad.

4. The support according to claim 3, wherein the impedance matching section is a ¼ wavelength transformer.

5. The support according to claim 4, wherein the at least one feed transition pad comprises:

at least one ¼ wave transformer connection;

at least one shield connection;

the at least one ¼ wave transformer connection connected to the at least one shield connection by at least one feed connection;

at least one ground;

the at least one ground connected to the ground plane by a ground connection;

at least one via connects the at least one ¼ wave transformer connection to the ¼ wavelength transformer; and at least one other via adapted to connect the ground plane to a shield of a power feed.

6. The support according to claim 5, wherein the at least one transition pad comprises:

at least one upstream center wire connection and at least one downstream center wire connection;

at least one upstream shield connection and at least one downstream shield connection; and a plurality of transition connections;

the plurality of transition connections to connect the at least one upstream center wire connection to the at least one downstream shield connection and to connect the at least one upstream shield connection to the at least one downstream center wire connection.

7. The support according to claim 1, wherein the substrate is a printed circuit board.

8. The support according to claim 1, wherein the at least one transition pad comprises:

at least one upstream center wire connection and at least one downstream center wire connection;

at least one upstream shield connection and at least one downstream shield connection; and a plurality of transition connections;

the plurality of transition connections to connect the at least one upstream center wire connection to the at least one downstream shield connection and to connect the at least one upstream shield connection to the at least one downstream center wire connection.

9. An omni-directional antenna array, comprising:

a substrate;

at least one transition pad placed on the substrate;

at least one feed transition pad placed on the substrate;

at least a first coaxial cable connected to the at least one feed transition pad and a downstream side of the at least one transition pad; and at least a second coaxial cable connected to an upstream side of the at least one transition pad.

10. The omni-directional antenna array according to claim 9, further comprising:

at least one ground plane placed on the substrate and connected to the at least one feed transition pad.

11. The omni-directional antenna array according to claim 10, further comprising:

at least one impedance matching section connected to the at least one feed transition pad.

12. The omni-directional antenna array according to claim 9, wherein at least the first coaxial cable and at least the second coaxial cable comprises one of 50 ohm coaxial cable or 75 ohm coaxial cable.

13. The omni-directional antenna array according to claim 9, wherein the substrate is non-conductive.

14. The omni-directional antenna array according to claim 13, wherein the substrate is a printed circuit board.

15. The omni-directional antenna array according to claim 9, wherein the at least one transition pad is conductive and the at least one feed transition pad is conductive.

16. The omni-directional antenna array according to claim 15, wherein, the at least one transition pad and the at least one feed transition pad comprise the same material.

17. The omni-directional antenna array according to claim 9; wherein, the downstream side of the at least one transition pad comprises a downstream center wire connection and a downstream shield connection; and the upstream side of the at least one transition pad comprises an upstream center wire connection and an upstream shield connection, wherein, the first coaxial cable comprises at least a first center wire and a first shield and the second coaxial cable comprises at least a second center wire and a second shield, the first center wire is connected to the downstream center wire connection and the first shield is connected to the downstream shield connection, and the second center wire is connected to the upstream center wire connection and the second shield is connected to the upstream shield connection, such that the first center wire is electrically connected to the second shield and the first shield is electrically connected to the second center wire.

18. The omni-directional antenna array according to claim 9, wherein the impedance matching section is a ¼ wavelength transformer.

19. The omni-directional antenna array according to claim 18, comprising:

at least one ¼ wave transformer connection;

at least one shield connection;

the at least one ¼ wave transformer connection connected to the at least one shield connection by at least one feed connection;

at least one ground;

the at least one ground connected to the ground plane by a ground connection;

at least one via connects the at least one ¼ wave transformer connection to the ¼ wavelength transformer, and at least one other via adapted to connect the ground plane to a shield of a power feed.

20. The omni-directional antenna array according to claim 19, comprising:

at least one power feed;

the at least one power feed comprising a power center wire and a power shield;

the power center wire connected to the ¼ wavelength transformer; and the power shield connected to a ground plane connector, such that the power center wire is electrically connected to the ¼ wave transformer connection by the ¼ wavelength transformer and a first via and the power shield is electrically connected to the ground plane by a second via.

21. The omni-directional antenna array according to claim 20, wherein:

wherein, the downstream side of the at least one transition pad comprises a downstream center wire connection and a downstream shield connection; and the upstream side of the at least one transition pad comprises an upstream center wire connection and an upstream shield connection, wherein, the first coaxial cable comprises at least a first center wire and a first shield and the second coaxial cable comprises at least a second center wire and a second shield, the first center wire is connected to the downstream center wire connection and the first shield is connected to the downstream shield connection, and the second center wire is connected to the upstream center wire connection and the second shield is connected to the upstream shield connection, such that the first center wire is electrically connected to the second shield and the first shield is electrically connected to the second center wire.

22. The omni-directional antenna array according to claim 9, wherein the connections are formed by at least one of the group consisting of a solder connection, a press fit connection, a press in connection, an adhesive connection, a glued connection, a taped connection, a spring loaded connection.

23. An antenna array, comprising:

a substrate, a plurality of coaxial cable sections;

means for connecting the plurality of coaxial cable sections so that center wires are attached to shields;

the means for connecting attached to the substrate; and means for providing power to the antenna array.

24. The antenna array according to claim 23, wherein the means for connecting comprises conductive pads attached to the substrate.

25. The antenna array according to claim 23, wherein the means for providing power comprises:

at least one ground plane;

at least one impedance matching section; and at least one feed conductive pad.

26. The method according to claim 25, wherein the arranging steps comprises one of etching and attaching conductive material on the substrate.

27. The antenna array according to claim 23, wherein the means for connecting comprises at least one of the group consisting of a solder connection, a press fit connection, a press in connection, an adhesive connection, a glued connection, a taped connection, a spring loaded connection.

28. A method of making a support for an omni-directional antenna, the method comprising the steps of:

arranging at least one transition pad on a substrate, and arranging at least one feed transition pad on the substrate, wherein the arranging of the at least one transition pad and the at least one feed transition pad placed them to facilitate coaxial cable to form a co-linear coaxial antenna.

29. The method according to claim 28, further comprising:

arranging at least one ground plane on the substrate.

30. The method according to claim 29, further comprising:

arranging at least one impedance matching section on the substrate; and connecting the impedance matching section to the at least one feed transition pad.

31. The method according to claim 30, wherein the at least one impedance matching section is arranged on a different side of the substrate from the at least one ground plane, the at least one feed transition pad, and the at least one transition pad.

32. The method according to claim 31, further comprising the step of:

providing at least one via to connect the impedance matching section to the at least one feed transition pad.

33. The method according to claim 28, wherein the arranging steps comprises etching the substrate.

34. The method according to claim 28, wherein the arranging steps comprise at least attaching conductive material to the substrate.

35. A method of making an antenna array, comprising the steps of:

arranging at least one transition pad on a substrate;

arranging at least one feed transition pad on the substrate;

arranging at least one ground plane on the substrate;

connecting at least a first coaxial cable to the at least one feed transition pad and to a downstream side of the at least one transition pad;

connecting at least a second coaxial cable to an upstream side of the at least one transition pad.

36. The method according to claim 35, further comprising:

arranging at least one ground plane on the substrate.

37. The method according to claim 36, further comprising:

arranging at least one impedance matching section on the substrate; and connecting the impedance matching section to the at least one feed transition pad.

38. The method according to claim 35, wherein the step of connecting the first coaxial cable comprises the steps of:

connecting a first center wire of the first coaxial cable to a downstream center wire connection of the at least one transition pad, and connecting a first shield of the first coaxial cable to a downstream shield connection; and the step of connecting the second coaxial cable comprises the steps of:

connecting a second center wire of the second coaxial cable to an upstream center wire connection of the at least one transition pad, and connecting a second shield of the second coaxial cable to an upstream shield connection;

such that the first center wire is connected to the second shield and the first shield is connected to the second center wire.

39. The method according to claim 35, further comprising the step of:

connecting at least one power feed.

40. The method according to claim 35, wherein the step of connecting at least one power feed comprises the steps of:

connecting a power center to the impedance matching section, and connecting a power shield to the ground plane;

such that the power center wire is electrically connected to the at least one feed transition pad by a first via and the power shield is electrically connected to the ground plane by a second via.

* * * * *